US008333308B2

(12) United States Patent
Maginness

(10) Patent No.: US 8,333,308 B2
(45) Date of Patent: Dec. 18, 2012

(54) COMBINATION CARRIER UNIT AND HEAD SUPPORT APPARATUS

(76) Inventor: Joseph Gabriel Maginness, Belfast (GB)

( * ) Notice: Subject to any disclaimer, the term of this patent is extended or adjusted under 35 U.S.C. 154(b) by 830 days.

(21) Appl. No.: 12/097,702

(22) PCT Filed: Dec. 18, 2006

(86) PCT No.: PCT/GB2006/004713

§ 371 (c)(1),
(2), (4) Date: Nov. 3, 2008

(87) PCT Pub. No.: WO2007/068950

PCT Pub. Date: Jun. 21, 2007

(65) Prior Publication Data

US 2009/0283557 A1 Nov. 19, 2009

(30) Foreign Application Priority Data

Dec. 16, 2005 (GB) ..... 0525629.2

(51) Int. Cl.
*A45F 4/02* (2006.01)

(52) U.S. Cl. ..... 224/153

(58) Field of Classification Search ..... 224/153, 224/647, 648; 150/109
See application file for complete search history.

(56) References Cited

U.S. PATENT DOCUMENTS

| | | | | |
|---|---|---|---|---|
| 245,639 | A | 8/1881 | Lay | |
| 2,172,178 | A * | 9/1939 | Rosenberg | 248/118 |
| 4,037,763 | A * | 7/1977 | Turchen | 224/153 |
| 4,095,726 | A * | 6/1978 | Hechler et al. | 222/175 |
| 4,114,197 | A * | 9/1978 | Morton | 2/423 |
| 4,235,472 | A | 11/1980 | Sparks et al. | |
| 4,236,264 | A * | 12/1980 | Britzman | 5/640 |
| 4,821,339 | A * | 4/1989 | Fair | 2/462 |
| 5,431,317 | A * | 7/1995 | Kliot | 224/153 |
| 5,505,523 | A * | 4/1996 | Wang | 297/393 |
| 5,590,825 | A * | 1/1997 | Murdock | 224/156 |
| 5,611,601 | A * | 3/1997 | Cowgur | 297/393 |
| 5,676,293 | A * | 10/1997 | Farris | 224/576 |
| 6,098,857 | A | 8/2000 | Le Gal | |
| 6,336,576 | B1 * | 1/2002 | Easter | 224/153 |
| 6,409,060 | B2 * | 6/2002 | Donine | 224/160 |
| 6,973,691 | B1 * | 12/2005 | Cordova et al. | 5/652 |
| 7,681,769 | B2 * | 3/2010 | Kramer | 224/581 |
| 7,788,751 | B1 * | 9/2010 | Diemer et al. | 5/644 |
| 2001/0029630 | A1 * | 10/2001 | Cortese et al. | 5/636 |
| 2002/0050009 | A1 | 5/2002 | Ley | |
| 2004/0064893 | A1 | 4/2004 | Sharp | |
| 2004/0124685 | A1 | 7/2004 | Buch | |
| 2004/0262865 | A1 | 12/2004 | Sigler | |
| 2006/0138188 | A1 * | 6/2006 | Kramer | 224/581 |
| 2008/0271742 | A1 * | 11/2008 | Maginness | 128/845 |

FOREIGN PATENT DOCUMENTS

| | | |
|---|---|---|
| EP | 0960587 A1 | 12/1999 |
| NL | 1017050 | 7/2002 |

* cited by examiner

*Primary Examiner* — Brian D Nash
(74) *Attorney, Agent, or Firm* — Tod R. Nissle, P.C.

(57) ABSTRACT

A combination carrier unit and head support apparatus has a carrier unit body with fastening members for releasably fastening the combination carrier unit and head support apparatus to a person. The carrier unit body has a head support in the form of a cushion releasably mountable thereon for supporting a person's head. The cushion may be inflatable or constructed of foam material and is provided with an attachment element to mount the cushion onto the carrier unit body.

31 Claims, 3 Drawing Sheets

COMBINATION CARRIER UNIT AND HEAD SUPPORT APPARATUS

CROSS-REFERENCE TO RELATED APPLICATIONS

This application is a 35 USC 371 application of PCT/GB2006/004713filed on Dec. 18, 2006. In addition, this application is related to applicant's prior application Number 11/629,802, which is directed to a light weight head support for use in confined spaces.

BACKGROUND OF THE INVENTION

1.Field of the Invention

This invention relates to a combination carrier unit and head support apparatus and in particular to a light weight combination carrier unit and head support apparatus for use in confined spaces.

2. Description of the Prior Art

Hereinafter in the specification and claims, the term "rucksack" is used to include not only a rucksack but also a backpack, a knapsack and any other similar container having straps allowing the container to be carried on the human body for example a hand bag, a sports bag or a briefcase.

SUMMARY AND ADVANTAGES OF THE INVENTION

Due to increased volumes of traffic on the road and rail infrastructures and increased volumes of national and International airline flights, a greater number of passengers spend an increasing number of hours travelling which generally involves sitting in confined spaces. These spaces are particularly uncomfortable if a passenger is required to rest in an upright sitting position for prolonged periods of time for example on a long haul flight in an economy class aeroplane seat. Passengers encounter problems with trying to sleep under these conditions and one problem occurs as a direct result of the weight of the passengers' heads. When a person starts to slip into a light sleep, the muscles of the neck relax and the head drops suddenly causing a small shock to the body of the passenger as a result of the jerking motion and the passengers' light sleep is broken. This cycle is repeated generally until the passenger finds a position where the weight of the head has at least partial support avoiding the jerking action of the head. The problem with this type of resting position is that the passenger often wakens up with a strain in their neck muscles.

It is an object of the present invention to obviate or mitigate the above outlined problem.

Accordingly, the present invention provides a combination carrier unit and head support apparatus having a carrier unit with fasteners for releasably fastening the carrier unit to a person, the carrier unit having a head support for supporting a person's head.

Preferably, the carrier unit is a rucksack.

Alternatively, the carrier unit is a baby carrier.

Ideally, the head support is a cushion desirable separable from the carrier unit.

Ideally, the cushion has a recess defined along a recess edge thereof for receiving a person's lower jaw.

Preferably, the cushion has extension portions for supporting either or both of a person's cheek bones.

Ideally, the fasteners of the carrier unit comprises at least one length adjustable strap. This strap may be arranged diagonally.

Preferably, the cushion has an attachment device for releasably attaching the cushion onto corresponding attachment means on the carrier unit.

Preferably, two length adjustable straps are located on the carrier unit, each having a length adjustment buckle.

Ideally, a carrier unit has a torso engaging edge and a head supporting edge opposite the torso engaging edge.

The torso engaging edge of the carrier unit body is desirably formed for engaging a portion of the person's body when the person is sitting in a substantially upright position preventing the head support from falling away from the lower jaw area of the person.

Advantageously, the weight of the person's head is transmitted through the head support and carrier unit and back to their own body with the carrier unit and head support acting as a strut.

Preferably, the carrier unit has an elongate body so that the torso engaging edge of the carrier unit body rests against the stomach region or lap of a person in use.

Advantageously, the elongate carrier unit body has a large surface area resting against the person's torso which generates additional friction further preventing the head support from falling away from the person's lower jaw area.

Preferably, a provision is made for releasably securing a person's arms on the carrier unit body.

Ideally, the provision for releasably securing the person's arms are provided onthe surface of the carrier body unit distal to the person's chest in use.

Advantageously, the arm securing provision provides support for a person's arms during sleeping in a confined space and the person is encouraged to sleep in the natural fetal position.

Ideally, a stiffening member is disposed within the carrier unit body.

Preferably, the stiffening member is a rigid board. This board may be of wood, plastics material or other suitable material.

Ideally, the rigid board is disposed within the rucksack or baby carrier.

Ideally, a support insert is disposed within the carrier unit for engaging and supporting the cushion in use. This prevents the cushion from possibly collapsing forward on top of the carrier unit. The support insert may be of foam or be inflatable.

Preferably, the head support is an inflatable body.

Alternatively, the body of the head support is manufactured from foam.

Preferably, the foam of the body is at least partially covered with a material having a high co-efficient of friction.

Ideally, the head support is a combination of a foam insert coated with an outer skin.

Preferably, the recess in the cushion has a hemi-conical surface expanding from the surface of the cushion proximal to a person's neck in use to the surface distal from a person's neck in use with the hemi-conical surface having a longitudinal axis substantially orthogonal to the main plane of the combination carrier unit and head support apparatus.

Ideally, the cushion has a protuberance extending rearward from the cushion.

Preferably, the arm securing provision is at least one adjustable strap.

Alternatively the arm securing provision is a pocket of the type having two lateral openings.

BRIEF DESCRIPTION OF THE DRAWINGS

This invention will now be described with reference to the accompanying drawings which show, by way of example only, one embodiment of a combination carrier unit and head support apparatus in accordance with the invention. In the drawings.

DESCRIPTION OF THE PREFERRED EMBODIMENT

Figure 1:
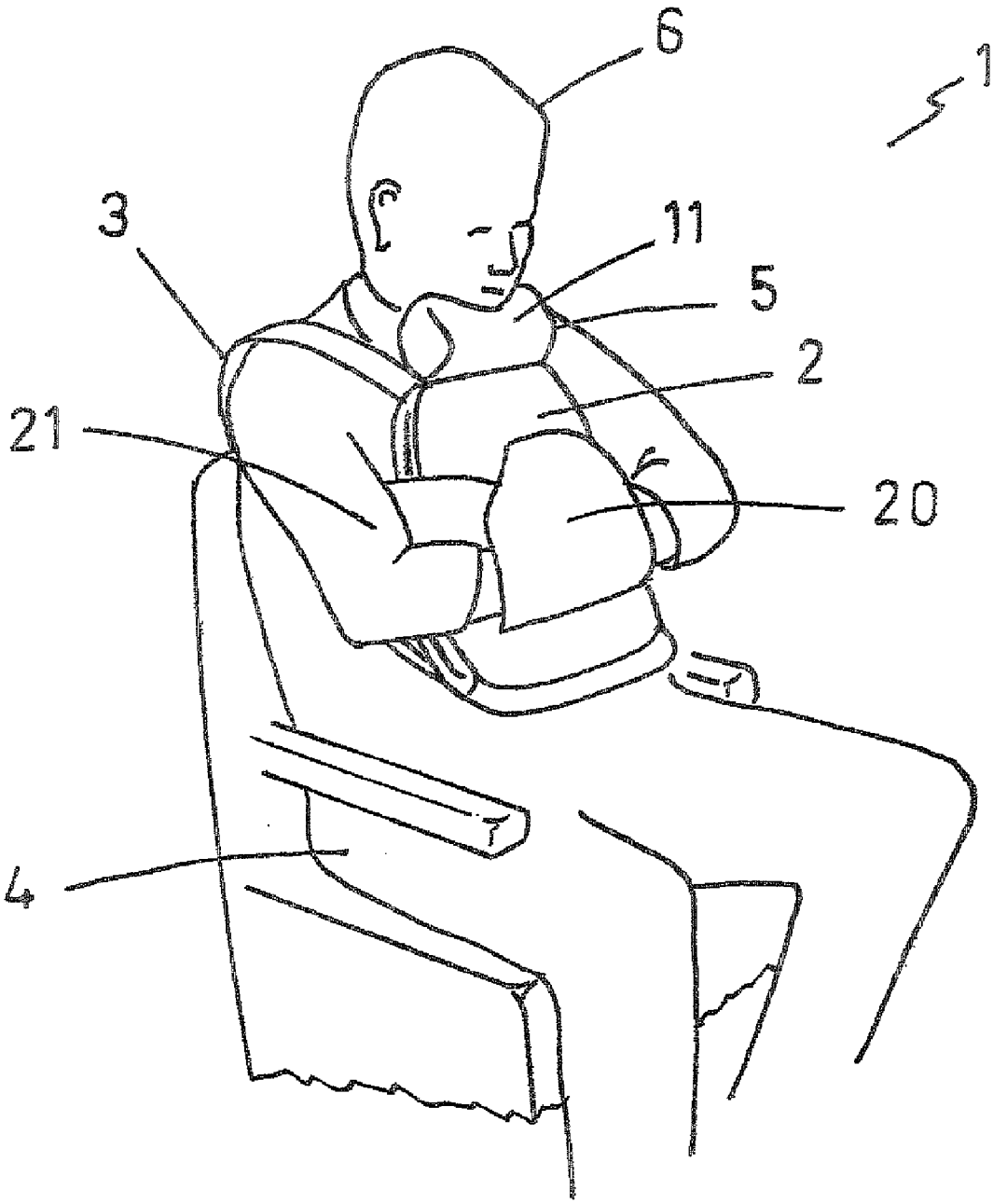
FIG. 1 is a perspective view of a person holding a combination carrier unit and head support apparatus.
Figure 2:
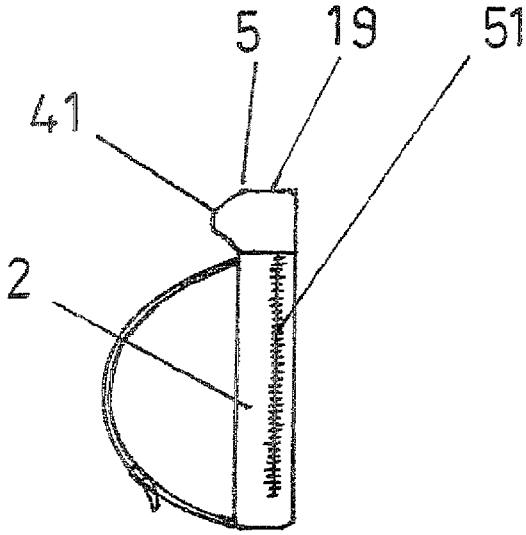
FIG. 2 is a side view of the combination carrier unit and head support apparatus of FIG. 1.

Referring to the drawings generally there is shown a combination carrier unit and head support apparatus indicated generally by the reference numeral 1. The combination carrier unit and head support apparatus 1 having a carrier unit 2 with fastening members 3 for releasably fastening the combination carrier unit and head support apparatus I to the torso of a person 4. A zipper 51 is also provided for allowing access to the inside of the carrier unit 2. The carrier unit 2 has a head support means 5 releasably mounted thereon for supporting a person's head 6. The carrier unit 2 shown in the drawings is a rucksack which is commonly used all over the world for carrying a wide range of various articles from books to clothes. In an alternative embodiment of combination carrier unit and head support apparatus 1 which is not illustrated in the drawings, the carrier unit can be a baby carrier which are also now commonly used by parents for transporting their children without requiring the use of their hands.

Figure 4:
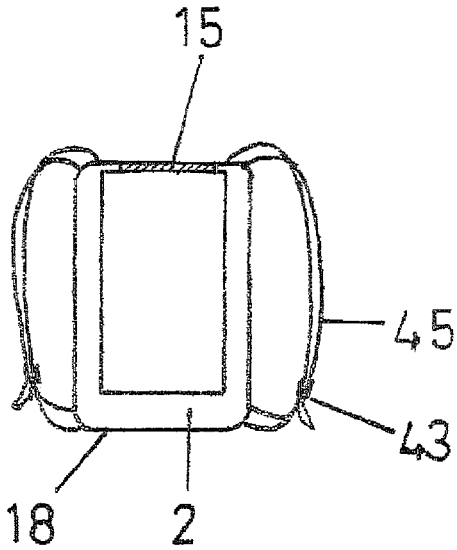
FIG. 4 is a front elevational view of the combination carrier unit and head support apparatus of FIGS. 1 to 3.
Figure 5:
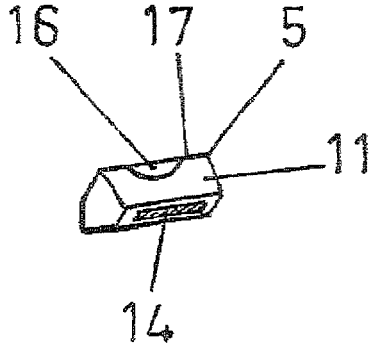
FIG. 5 is a perspective view of a head support member
Figure 6:
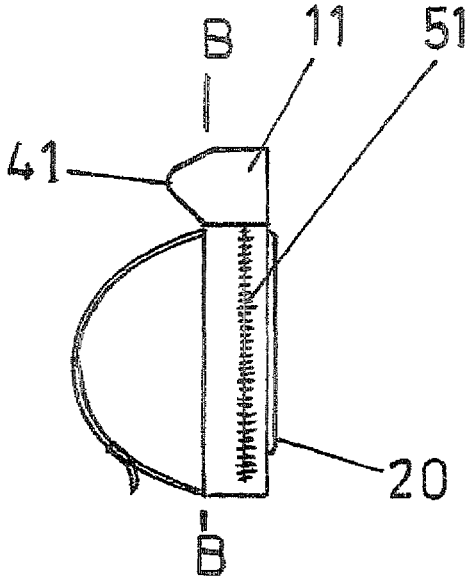
FIG. 6 is the same side view as FIG. 2 showing a hand support member.

The head support means 5 is a separable cushion 11 and the cushion 11 has an attachment element 14 such as Velcro™, see FIG. 5, or some similar fastening element for releasably fastening the cushion 11 onto a corresponding attachment element 15 on the carrier unit 2, see FIG. 4.

The cushion 11 has a recess 16 defined along a recess edge 17 of the cushion 11 for receiving the person's lower jaw. The cushion has a lateral extension portion 118, see FIG. 9 for supporting either or both of a person's cheek bones, if two lateral extensions portions 118 are provided.

The carrier unit 2 has a torso engaging edge 18 and a head supporting edge 19 opposite the torso engaging edge 18. The torso engaging edge 18 of the carrier unit 2 is formed for engaging a portion of the person's body when the person 4 is sitting in a substantially upright to position preventing the head supporting member 5 from falling away from the lower jaw area of the person 4.

Advantageously, the weight of the person's head 6 is transmitted through the head support means 5 and carrier unit 2 and back to their own human body with the carrier unit 2 and head support means 5 acting as a strut.

The carrier unit 2 has an elongate body so that the torso engaging edge 18 of the carrier unit 2 rests against the stomach region or lap of a person 4 in use.

Advantageously, the elongate carrier unit 2 has a large surface area resting against the person's torso which generates additional friction further preventing the head support member 5 from falling away from the person's lower jaw area.

A pocket 20 for releasably securing a persons arms 21 is provided on the carrier unit 2 on the surface of the carrier unit 2 distal to the person's chest in use. Advantageously, this pocket 20 provides support for a person's arms 21 during sleeping in a confined space and the person 4 is encouraged to sleep in the natural fetal position. The pocket 20 comprises a patch of material being sewn onto the rucksack along two stitch lines leaving two lateral openings for 25 receiving the person's arms 21. Alternatively, a single strap is attached to the rucksack through which a person 4 folds their arms 21.

Figure 8:
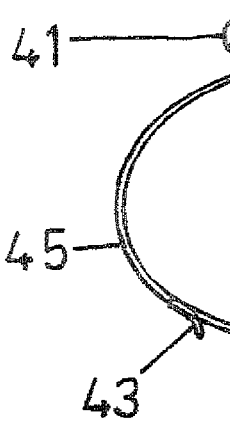
FIG. 8 is a cross-sectional view taken along A-A of FIG. 7.
Figure 9:
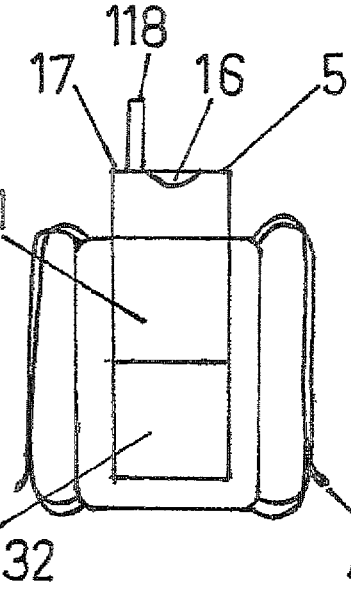
FIG. 9 is a cross-sectional view taken along B-B of FIG. 6.
Figure 10:
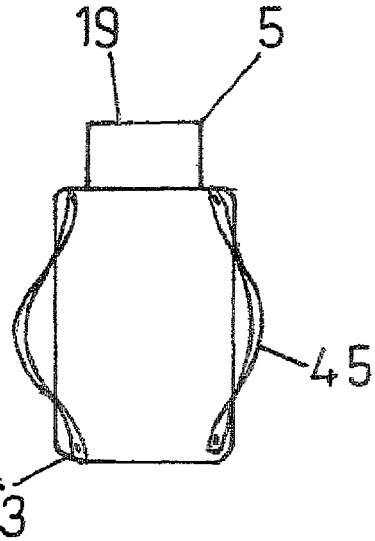
FIG. 10 is a rear elevational view of the combination carrier unit and head support apparatus.

Referring to FIGS. 8 and 9, a stiffening member 31 is disposed within the rucksack comprising a rigid board 32. The rigid board 32 allows the rucksack to be used as a strut arrangement to support a persons head even when the rucksack is empty. In effect, the rucksack and head support combination unit I can work without the rigid board 32 if the rucksack 7 was packed with clothes or other articles. The board may be of inverted "L" shape to allow the cross-piece to support the cushion 11. Alternatively, as shown in FIGS. 8 and 9, the board is flat with foam insert 81 secure thereto and disposed within the carrier unit 2 for engaging and supporting the cushion 11 preventing the cushion 1I collapsing into the top of the rucksack in use. The board may be constructed of wood, plastics material or other suitable material.

The head support means 5 is an inflatable body or alternatively the cushion of the head support means 5 is manufactured from foam. The foam can be at least partially covered with a material having a high co-efficient of friction.

In an alternative construction, the head support means 5 is a combination of a foam insert coated with an outer skin.

Figure 7:
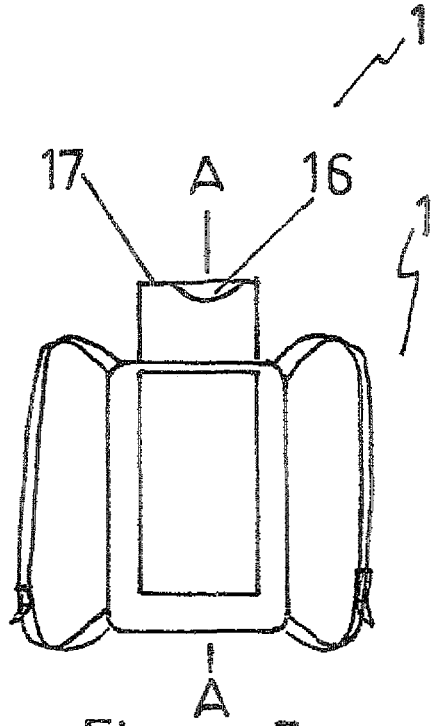
FIG. 7 is a rear elevational view of the combination carrier unit and head support apparatus of FIG. 6.

Referring now to FIGS. 7, 8 and 9 the recess 16 in the cushion 11 has a hemi-conical surface expanding from the surface of the cushion proximal to a person's neck in use to the surface distal from a person's neck in use with the hemi-conical surface having a longitudinal axis substantially orthogonal to the main plane of the combination carrier unit and head support apparatus 1.

The cushion 11 has a protuberance 41 extending rearward from the cushion 11. The effect of the protuberance 41 is to propel the hemi-conical surface of the recess 16 up and out from the person's neck to hold the person's head in the most upright position possible within the geometrical constraints imposed by the width of the cushion 11 and the width of the protuberance 41. Otherwise, the weight of the person's head may compress the deformable recess portion negating the desired effect of the head support means 5. This acts to position cushion recess 16 under the chin and keeps it away from the carotic artery.

It will also be appreciated that additional belts may be attached to the cushion which can extend around the neck of a person using the combination carrier unit and head support apparatus 1 to retain the apparatus 1 in the correct position relative to the head.

Figure 3:
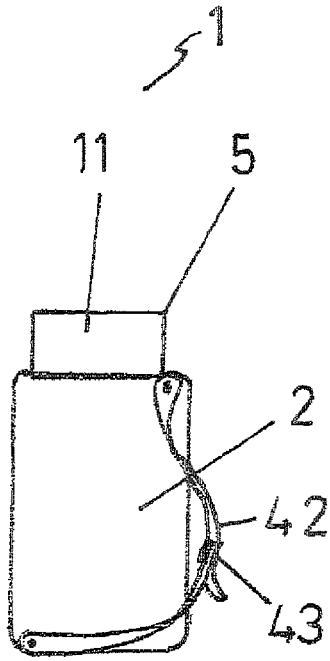
FIG. 3 is a rear elevational view of the combination carrier unit and head support apparatus of FIG. 1 and FIG. 2.

A single diagonal length adjust able strap 42 with buckle 43, see FIG. 3, or two length adjustable straps 45 each having a buckle 43, see FIGS. 1, 4, 7, 9 and 10 are provided for fastening the rucksack to the person's body. Adjusting the straps 42, 45 will raise or lower the headrest.

In a first modification, the cushion when not in use is accommodated in the top of the rucksack. This could be either as a separate part or could be that the cushion is secured to a flap secured inside of the rucksack and, for use, could be hinged outwardly from inside the rucksack to outside the rucksack when the rucksack is open.

In a second modification, the rucksack may have a carrying handle at its upper side. The handle may have a zip or co-operating fasteners which when opened allows a compressed cushion of foam to be released to provide the head support means. Alternatively, the handle may accommodate an inflatable bag which when inflated provides the head support means.

Variations and modifications can be made without departing from the scope of the invention as outlined above and as claimed hereinafter.

The invention claimed is:

1. A combination carrier unit and head support apparatus comprising:

a carrier unit body;

fastening means for releasably fastening the apparatus to the upper body of a person;

a cushion for supporting a person's head; and a stiffening member in the form of a rigid board disposed within the carrier unit body;

wherein the cushion has a recess defined along a recess edge of the cushion for receiving a person's lower jaw, and a protuberance extending rearward from the cushion, in use, wherein the carrier unit body has a torso engaging edge and a head supporting edge opposite the torso engaging edge, and wherein the carrier unit body has an elongate body so that the torso engaging edge of the carrier unit body rests against the stomach region or lap of a person, in use.

2. An apparatus according to claim 1, wherein the carrier unit body is a rucksack.

3. An apparatus according to claim 2, wherein the rigid board is disposed within the rucksack.

4. An apparatus according to claim 1, wherein the carrier unit body is a baby carrier.

5. An apparatus according to claim 4, wherein the rigid board is disposed within the baby carrier.

6. An apparatus according to claim 1, wherein the cushion is separable from the carrier unit body.

7. An apparatus according to claim 6, wherein the cushion has an attaching element for releasably fastening the cushion onto a corresponding attaching element on the carrier unit body.

8. An apparatus according to claim 1, wherein the cushion has lateral extension portions for supporting either or both of a person's cheek bones.

9. An apparatus according to claim 1, wherein the torso engaging edge of the carrier unit body engages a portion of the person's body when the person is sitting in a substantially upright position thereby preventing the cushion from falling away from the lower jaw area of the person.

10. An apparatus according to claim 9, wherein the carrier unit body has an elongate body so that the torso engaging edge of the carrier unit body rests against the stomach region or lap of a person, in use.

11. An apparatus according to claim 10, wherein the elongate body has a large surface area resting against, and frictionally engaging, the person's torso.

wherein frictionally engaging the person's torso further prevents the cushion from falling away from the person's lower jaw area.

12. An apparatus according to claim 1, wherein, in use, the weight of the person's head is transmitted through the cushion and carrier unit body and back to their own body with the carrier unit body and cushion acting as a strut.

13. An apparatus according to claim 12, wherein the carrier unit body has an elongate body so that the torso engaging edge of the carrier unit body rests against the stomach region or lap of a person, in use.

14. An apparatus according to claim 13, wherein the elongate body has a large surface area resting against, and frictionally engaging, the person's torso.

wherein frictionally engaging the person's torso further prevents the cushion from falling away from the person's lower jaw area.

15. An apparatus according to claim 1, wherein the elongate body has a large surface area resting against, and frictionally engaging, the person's torso, wherein frictionally engaging the person's torso further prevents the cushion from falling away from the person's lower jaw area.

16. An apparatus according to claim 1, wherein arm securing means for releasably securing a passenger's arms are provided on the carrier unit body.

17. An apparatus according to claim 16, wherein the arm securing means are provided on the surface of the carrier body unit distal to the person's chest, in use.

18. An apparatus according to claim 17, wherein the arm securing means provides support for a person's arms during sleeping in a confined space.

19. An apparatus according to claim 16, wherein the arm securing means provides support for a person's arms during sleeping in a confined space.

20. An apparatus according to claim 16, wherein the arm securing means is at least one adjustable strap.

21. An apparatus according to claim 16, wherein the arm securing means is a pocket of the type having two lateral openings.

22. An apparatus according to claim 1, wherein the cushion is an inflatable body.

23. An apparatus according to claim 1, wherein the cushion is manufactured from foam.

24. An apparatus according to claim 23, wherein the foam is at least partially covered with a material having a high co-efficient of friction.

25. An apparatus according to claim 24, wherein the cushion is a combination of a foam insert coated with an outer skin.

26. An apparatus according to claim 23, wherein the cushion is a combination of a foam insert coated with an outer skin.

27. An apparatus according to claim 1, wherein the recess in the cushion has a hemi-conical surface expanding from the surface of the cushion proximal to a person's head, in use, to the surface distal from a person's head, in use, with the hemi-conical surface having a longitudinal axis substantially orthogonal to the main plane of the combination carrier unit and head support apparatus.

28. An apparatus according to claim 19, wherein the fastening means of the carrier unit body comprises at least one length adjustable strap.

29. An apparatus according to claim 28, wherein the fastening means comprises two length- adjustable straps located on the carrier unit body, each having a length adjustable buckle.

30. A combination carrier unit and head support apparatus comprising:

a carrier unit body;

fastening means for releasably fastening the apparatus to the upper body of a person;

a cushion for supporting a person's head; and a stiffening member in the form of a rigid board disposed within the carrier unit body;

wherein the cushion has a protuberance extending rearward from the cushion, in use, and lateral extension portions for supporting either or both of a person's cheek bones, wherein the carrier unit body has a torso engaging edge and a head supporting edge opposite the torso engaging edge, and wherein the carrier unit body has an elongate body so that the torso engaging edge of the carrier unit body rests against the stomach region or lap of a person, in use.

31. A combination carrier unit and head support apparatus comprising:

a carrier unit body;

fastening means for releasably fastening the apparatus to the upper body of a person;

a cushion for supporting a person's head; and a stiffening member in the form of a rigid board disposed within the carrier unit body;

wherein the cushion has a protuberance extending rearward from the cushion, in use, a recess defined along a recess edge of the cushion for receiving a person's lower jaw, and lateral extension portions for supporting either or both of a person's cheek bones wherein the carrier unit body has a torso engaging edge and a head supporting edge opposite the torso engaging edge, and wherein the carrier unit body has an elongate body so that the torso engaging edge of the carrier unit body rests against the stomach region or lap of a person, in use.

* * * * *